US010618327B2

(12) United States Patent
Iwano et al.

(10) Patent No.: US 10,618,327 B2
(45) Date of Patent: Apr. 14, 2020

(54) LIQUID EJECTION HEAD UNIT AND LIQUID EJECTION APPARATUS

(71) Applicant: CANON KABUSHIKI KAISHA, Tokyo (JP)

(72) Inventors: Takuya Iwano, Inagi (JP); Toshiaki Hirosawa, Hiratsuka (JP); Hiromasa Amma, Kawasaki (JP); Tomoki Tsuji, Naka-gun (JP); Akira Kida, Yokohama (JP); Tetsuji Kurata, Yokohama (JP); Atsushi Kohnotoh, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/023,813

(22) Filed: Jun. 29, 2018

(65) Prior Publication Data

US 2019/0009540 A1 Jan. 10, 2019

(30) Foreign Application Priority Data

Jul. 7, 2017 (JP) ..... 2017-133993

(51) Int. Cl.

| | |
|---|---|
| ***B41J 29/12*** | (2006.01) |
| ***B41J 2/165*** | (2006.01) |
| ***B41J 2/155*** | (2006.01) |
| ***B41J 29/13*** | (2006.01) |

(52) U.S. Cl.

CPC ..... *B41J 29/12* (2013.01); *B41J 2/155* (2013.01); *B41J 2/16505* (2013.01); *B41J 2/16508* (2013.01); *B41J 2/16585* (2013.01); *B41J 29/13* (2013.01); *B41J 2002/16502* (2013.01); *B41J 2202/20* (2013.01); *B41J 2202/21* (2013.01)

(58) Field of Classification Search

CPC .... B41J 2/16585; B41J 2/155; B41J 2202/20; B41J 2202/21; B41J 2/16508; B41J 2/16511; B41J 2/16505; B41J 29/13; B41J 29/12

See application file for complete search history.

(56) References Cited

U.S. PATENT DOCUMENTS 5,572,245 A * 11/1996 Cowger ..... B41J 2/16505 347/29

2017/0326875 A1 11/2017 Nakakubo et al.
2018/0086064 A1 3/2018 Kimura et al.
2018/0361748 A1 12/2018 Inada et al.
2019/0009542 A1 1/2019 Tsuji et al.

FOREIGN PATENT DOCUMENTS

JP 2001-063080 A 3/2001

* cited by examiner

*Primary Examiner* — Geoffrey S Mruk
(74) *Attorney, Agent, or Firm* — Venable LLP

(57) ABSTRACT

A liquid ejection head unit is formed by arranging a plurality of recording element substrates in a first direction. Each recording element substrate has an ejection orifice from which a liquid is ejected. The liquid ejection head unit includes rail portions extending in the first direction and a protective member which is detachably fitted on the rail portions. The protective member is movable along the rail portions between a first position and a second position. The first position allows the protective member to cover whole surfaces of the plurality of recording element substrates. The second position allows the plurality of recording element substrates to be exposed so as to allow a liquid to be ejected from the ejection orifices.

20 Claims, 5 Drawing Sheets

LIQUID EJECTION HEAD UNIT AND LIQUID EJECTION APPARATUS

BACKGROUND OF THE INVENTION

Field of the Invention

The present invention relates to a liquid ejection head unit to be mounted on a liquid ejection apparatus and the liquid ejection apparatus.

Description of the Related Art

A liquid ejection apparatus ejects a liquid, such as a recording liquid, to a recording medium so as to perform recording. Such a liquid ejection apparatus generally includes: a liquid ejection head having a plurality of ejection orifices from which a liquid is ejected; a carriage which mounts the liquid ejection head thereon; a unit for conveying a recording medium; and a control unit for controlling these parts. Depending on a recording system, a liquid ejection apparatus is classified into a liquid ejection apparatus of a serial scanning type or a liquid ejection apparatus of a page-wide type. An apparatus of a serial scanning type performs a recording operation while causing a carriage to move. In contrast, an apparatus of a page-wide type uses a liquid ejection head having a size which corresponds to the width of a recording medium (that is, a liquid ejection head of a page-wide type), and the apparatus performs a recording operation in a state where a carriage is fixed and only the recording medium is conveyed. In the liquid ejection head of a page-wide type, an ejection module has a plurality of ejection orifices from which a liquid is ejected, and the ejection module is disposed over the whole length which corresponds to the width of the recording medium.

To prevent damage or contamination of an ejection module during transportation of a liquid ejection head or during handling of the liquid ejection head, the liquid ejection head is protected using a protective member which covers the whole surface of the ejection module in many cases. Japanese Patent Application Laid-Open No. 2001-063080 discloses a protective member which is used for a liquid ejection head for a liquid ejection apparatus of a serial scanning type, and the protective member includes pawl-like engaging portions for fixing the protective member to the liquid ejection head. The protective member has a cap shape. The protective member is installed so as to cover a surface in which ejection orifices are formed. The protective member faces the liquid ejection head from the direction orthogonal to the surface in which the ejection orifices are formed. When the protective member described in Japanese Patent Application Laid-Open No. 2001-063080 is used, to mount a liquid ejection head on a liquid ejection apparatus, first, the engaging portions of the protective member are released so as to remove the protective member from the liquid ejection head. Thereafter, the liquid ejection head is mounted on the liquid ejection apparatus.

If a large-sized or elongated liquid ejection head, such as a liquid ejection head of a page-wide type, is dropped, a large impact is caused. Accordingly, there is a possibility of the engaging portion of the protective member being broken due to such an impact, such that the protective member separates from the liquid ejection head and, as a result, the ejection module being contaminated or broken. To lower the risk of breakage of the engaging portion, an increase in the number of engaging portions or forming the engaging portion with a large size may be considered. However, in such cases, operability in removing the protective member from the liquid ejection head is lowered.

The present invention has been made to solve the above-mentioned problems, and it is an object of the present invention to provide a liquid ejection head of a page-wide type which has high resistance against an impact caused by dropping or the like, and which is excellent in operability in removing a protective member. It is also an object of the present invention to provide a liquid ejection apparatus which uses such a liquid ejection head.

SUMMARY OF THE INVENTION

The present invention is directed to a liquid ejection head unit including: a liquid ejection head of a page-wide type to be installed into a liquid ejection apparatus, the liquid ejection head being formed by arranging a plurality of recording element substrates in a first direction, each of the recording element substrates having an ejection orifice from which a liquid is ejected; and a protective member configured to protect the plurality of recording element substrates, wherein the liquid ejection head includes a plurality of rail portions mutually extending along the first direction, and the protective member is movable along the rail portions between a first position and a second position, the first position allowing the protective member to cover whole surfaces of the plurality of recording element substrates, and the second position allowing the plurality of recording element substrates to be exposed so as to allow a liquid to be ejected from the ejection orifice.

The present invention is also directed to a liquid ejection apparatus including: the liquid ejection head unit of the present invention; and an opening into which the liquid ejection head unit is to be inserted, wherein the liquid ejection head unit is inserted into the opening along a first direction.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

First Embodiment

Figure 1A:
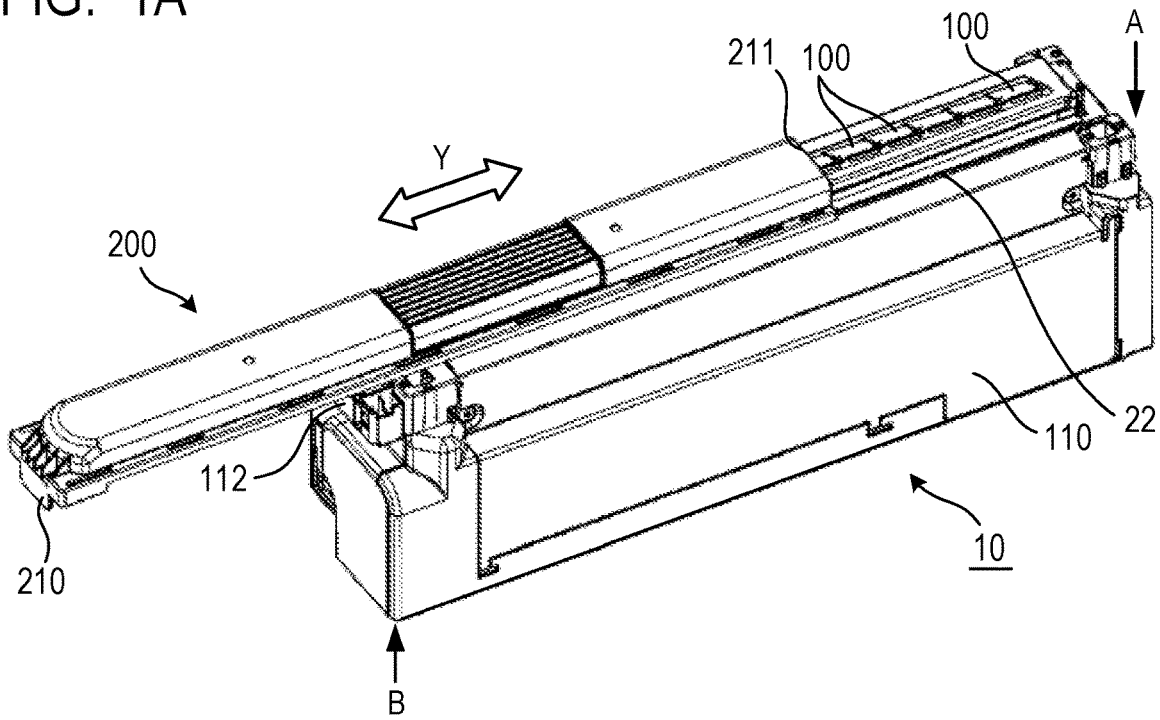
FIG. 1A and FIG. 1B are views illustrating a liquid ejection head of a first embodiment of the present invention.
Figure 1B:
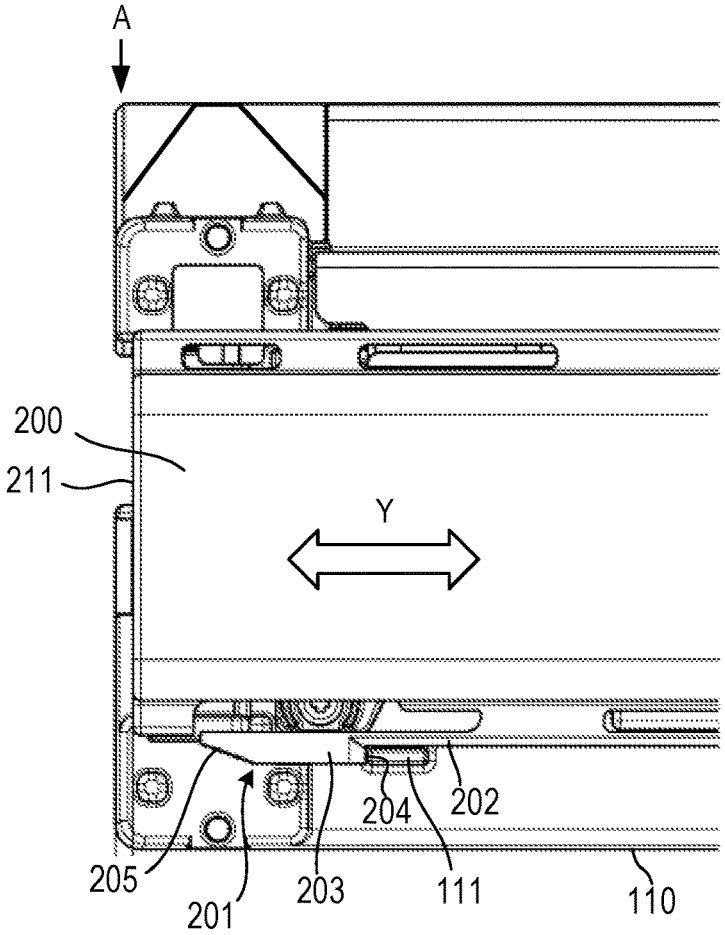

Next, an exemplary embodiment of the present invention is described with reference to the drawings. FIG. 1A and FIG. 1B are views illustrating a liquid ejection head of a first embodiment. FIG. 1A is a perspective view, and FIG. 1B is a view illustrating the shape of a fixing portion of a protective member. In the description made hereinafter, the description is made by exemplifying a so-called liquid ejection head of a thermal system. In the liquid ejection head of a thermal system, a heat generating element is used as a recording element which generates energy for ejecting a liquid, and air bubbles are generated in a liquid in a pressure chamber by heat thus causing the liquid to be ejected from ejection orifices. However, a liquid ejection head to which the present invention is applicable is not limited to a liquid ejection head of a thermal system. The present invention is also applicable to a liquid ejection head of a piezo system where a piezoelectric element is used, or to a liquid ejection head which adopts any of other various liquid ejection systems. In this embodiment, a liquid is a recording liquid represented by an ink, for example. However, the liquid may be a liquid other than an ink.

A liquid ejection head of the present invention which ejects a liquid such as an ink and a liquid ejection apparatus which mounts the liquid ejection head thereon are applicable to such apparatus as a printer, a copying machine, a facsimile machine which includes a communication system, or a word processor which includes a printer portion. The liquid ejection head and the liquid ejection apparatus are also applicable to an industrial recording apparatus which is multiply combined with various processing apparatuses. For example, the liquid ejection head and the liquid ejection apparatus can be used for the application of manufacturing biochips, printing electronic circuits, manufacturing semiconductor substrates, a 3D printer or any other applications.

A liquid ejection head unit 10 illustrated in FIG. 1A includes a liquid ejection head 110 and a protective member 200. The liquid ejection head unit 10 is a long liquid ejection head of a page-wide type where a plurality of recording element substrates 100 are arranged along the longitudinal direction of the liquid ejection head unit 10 (the Y direction in the drawing). In the liquid ejection head, the respective recording element substrates 100 are arranged in a straight line (in line) along the longitudinal direction of the liquid ejection head. The recording element substrates 100 are formed on a surface of the liquid ejection head, and an aspect ratio of the surface is very large. The present invention is not limited to such a mode where in-line arrangement is adopted, and is also applicable to a mode where the recording element substrates 100 are arranged in a staggered manner. Although described later, the present invention is effectively applicable particularly to such a long liquid ejection head with a narrow width. The present invention is favorably applicable particularly to a liquid ejection head where recording element substrates are formed on a surface of the liquid ejection head, and a ratio of the short side to the long side of the surface is 1:7 or more. As illustrated in the drawing, both ends of the liquid ejection head 110 in the longitudinal direction are respectively assumed as an end portion A and an end portion B. Each recording element substrate 100 is provided with a plurality of ejection orifices, a pressure chamber communicating with the ejection orifices, and recording elements. The recording element applies energy to a liquid in the pressure chamber to cause the liquid to be ejected. The recording elements disposed in the pressure chamber are provided for each respective ejection orifice. The plurality of ejection orifices are formed in a surface of the recording element substrate 100, and the surface is exposed. This surface is referred to as "ejection orifice surface".

When the liquid ejection head unit 10 is in the process of shipping in market or is being handled, the recording element substrate 100 or other components may be damaged or contaminated. To prevent such damage or contamination, a protective member 200 is mounted on the liquid ejection head 110, and covers whole surfaces of exposed portions of the recording element substrates 100. The protective member 200 moves in a sliding manner along rail portions 21, 22 (see FIG. 3), which are formed on the liquid ejection head 110, and are parallel to each other. Accordingly, the protective member 200 can slide and move in the Y direction in the drawing, that is, in the longitudinal direction of the liquid ejection head 110. The rail portions 21, 22 form a rail member. The Y direction in the drawing is also referred to as "first direction". FIG. 1A illustrates a state in the process of sliding the protective member 200 from the end portion B side toward the end portion A (from left to right in the drawing). When the protective member 200 is moved in the direction toward the end portion B, the protective member 200 is removed from the rail portion 22. Accordingly, the protective member 200 is detachable with respect to the rail portion 22 at the end portion B. In the illustration in FIG. 1A, the recording element substrates 100 face upward so that the ejection orifice surfaces face upward. However, when the liquid ejection head 110 is actually used, the ejection orifice surfaces are caused to direct downward in the direction of gravity, for example.

As illustrated in FIG. 1A, a stopper portion 210 is formed on the protective member 200 at the position of the left end in the drawing. An abutting portion 112 is formed on the liquid ejection head 110 on the end portion B side. The stopper portion 210 of the protective member 200 slides and, then, comes into contact with the abutting portion 112. Because the stopper portion 210 comes into contact with the abutting portion 112, there is no possibility that the protective member 200 slides rightward in the drawing with the position of a distal end 211 of the protective member 200 projecting beyond the end portion A of the liquid ejection head 110 to come off from the liquid ejection head 110. When the distal end 211 of the protective member 200 is at the position of the end portion A, it is assumed that the protective member 200 is at the first position. When the distal end 211 of the protective member 200 is at the position of the end portion B, all recording element substrates 100 are exposed from the protective member 200 so that a liquid can be ejected from the ejection orifices. When the protective member 200 is in such a state, it is assumed that the protective member 200 is at the second position.

FIG. 1B illustrates a portion in the vicinity of the end portion A of the liquid ejection head 110 in a state where the protective member 200 slides to the position of the end portion A so as to cover the whole surfaces of the plurality of recording element substrates 100. To prevent the protective member 200 covering the recording element substrates 100 to easily slide toward the end portion B side, a fixing portion 201 is formed on the protective member 200. FIG. 1B illustrates the liquid ejection head 110 in a state in which left and right are reversed from the state illustrated in FIG. 1A. The fixing portion 201 formed on the distal end 211 side of the protective member 200 is an elongated member extending toward the end portion A. The fixing portion 201 is formed of a support portion 202 and a distal end portion 203. The support portion 202 is formed on the proximal end side of the fixing portion 201, and is thin relative to the distal end portion 203. The distal end portion 203 is formed on a distal end of the support portion 202, and is thick compared to the support portion 202. The distal end portion 203 has a contact surface 204 at the position of a boundary between the support portion 202 and the distal end portion 203. The contact surface 204 intersects with (more preferably, is orthogonal to) the longitudinal direction of the liquid ejection head 110. A protrusion 111 is formed on the liquid ejection head 110 such that the protrusion 111 can engage with the contact surface 204. A tapered surface 205 is formed on an outer side surface of the distal end portion 203 on the distal end side. When the protective member 200 slides from the end portion B side, the tapered surface 205 comes into contact with the protrusion 111 so that the tapered surface 205 is pressed whereby the support portion 202 is bent inward. Accordingly, the protective member 200 can slide without any obstruction. Thereafter, when the distal end of the protective member 200 arrives at the end portion A, the contact surface 204 engages with the protrusion 111 and hence, the movement of the protective member 200 in the opposite direction, that is, in the direction toward the end portion B, is prevented. With such a configuration, the removal of the protective member 200 can be prevented. When the tapered surface 205 is pressed upward in the drawing (toward a body of the protective member 200) in such a state, the support portion 202 is bent inward so that the contact surface 204 separates from the protrusion 111. Accordingly, the protective member 200 can be removed from the liquid ejection head 110.

As described above, the protective member 200 is mounted on or detached from the liquid ejection head 110 by causing the protective member 200 to slide along the longitudinal direction of the liquid ejection head. In mounting or detaching the protective member 200 on or from the liquid ejection head 110, the sliding contact portions 23, 24 of the protective member slide while coming into contact with the rail portions 21, 22 of the liquid ejection head unit 10 and, thereafter, are fixed and engaged by the fixing portion 201 having an elastic latch lever structure. With such a configuration, the protective member 200 can be prevented from coming off even when a liquid ejection head is of a page-wide type having a long shape, and when an impact caused by dropping or the like is applied to the liquid ejection head. Further, the liquid ejection head is also excellent in operability in mounting or detaching the protective member.

Figure 2:
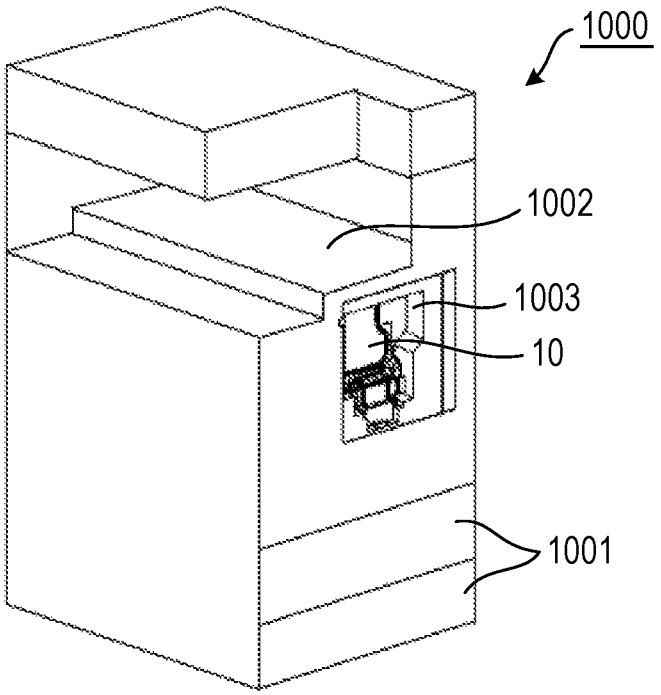
FIG. 2 is a perspective view illustrating a liquid recording apparatus.

FIG. 2 illustrates one example of a liquid ejection apparatus on which the liquid ejection head unit 10 (liquid ejection head 110) of this embodiment is to be mounted. FIG. 2 illustrates an external appearance of the liquid ejection apparatus. A liquid ejection apparatus 1000 illustrated in FIG. 2 is an apparatus which is formed as an ink jet recording apparatus, and uses a recording paper stored in a paper feeding cassette 1001 as a recording medium. The liquid ejection apparatus 1000 performs recording on the recording paper and, thereafter, discharges the recording paper to a paper discharge tray 1002. An opening 1003 is formed in a casing of the liquid ejection apparatus 1000, and the opening 1003 is covered by a cover (not illustrated in the drawing) in a normal state. The opening 1003 is connected to a hollow portion (not illustrated in the drawing) which receives the liquid ejection head unit 10 in the casing of the liquid ejection apparatus 1000. The opening 1003 forms an inlet for the hollow portion. The hollow portion is formed with a depth greater than the width of a recording paper stored in the paper feeding cassette 1001. Accordingly, the liquid ejection head unit 10 can be inserted into the hollow portion along the longitudinal direction of the liquid ejection head unit 10. In the liquid ejection apparatus 1000, a carriage (not illustrated in the drawing) which mounts the liquid ejection head 110 thereon is disposed in the hollow portion connected to the opening 1003.

Assume a case where the liquid ejection head unit 10 of this embodiment is mounted on the liquid ejection apparatus 1000. In such a case, the liquid ejection head unit 10 is used in a state where whole surfaces of the recording element substrates 100 are protected by the protective member 200 as described above. The liquid ejection head unit 10 is inserted into the opening 1003 along the longitudinal direction of the liquid ejection head unit 10 in an attitude where the recording element substrates 100 face downward. When the liquid ejection head unit 10 is inserted into the hollow portion inside the opening 1003, the tapered surface 205 of the fixing portion 201 of the protective member 200 comes into contact with and is pressed by a contact member (not illustrated in the drawing) formed on a depth portion of the hollow portion connected to the opening 1003 so that the contact surface 204 is removed from the protrusion 111. When the protective member 200 is in such a state, the protective member 200 can be caused to slide with respect to the liquid ejection head 110. Accordingly, only the protective member 200 is pulled back while the liquid ejection head unit 10 remains in the opening 1003 of the liquid ejection apparatus 1000 so as to remove the protective member 200 from a body portion. With such operations, the liquid ejection head unit 10 is mounted on the liquid ejection apparatus 1000. Therefore, the recording element substrates 100 can face a recording paper in the opening 1003 so that the recording can be performed on the recording paper from the recording element substrates 100.

As described above, the protective member 200 of the present invention is inserted into the liquid ejection apparatus 1000 in a state where the protective member 200 covers and protects the recording element substrates 100 of the liquid ejection head 110. After the liquid ejection head unit 10 is installed into the liquid ejection apparatus 1000, the protective member 200 is taken off from the liquid ejection head 110 so that only the protective member 200 can be removed from the liquid ejection apparatus 1000. With such a configuration, the recording element substrates 100 of the liquid ejection head 110 are protected by the protective member 200 during shipping of the liquid ejection head 110, during handling of a liquid ejection head and also during the process of installation of the liquid ejection head 110 into a liquid ejection apparatus. Accordingly, it is possible to suppress breakage of the recording element substrate 100 and contamination of hands of a user due to an ink ejected from an ejection orifice.

Both of the direction along which the protective member 200 is mounted on or detached from the liquid ejection head 110 (Y direction) and the direction along which the liquid ejection head unit 10 is mounted on or detached from the liquid ejection apparatus 1000 extend along the longitudinal direction of the liquid ejection head. Accordingly, it is possible to provide the configuration excellent in detachability of the protective member 200 and excellent in detachability of the liquid ejection head unit 10. Such a configuration is preferably applicable particularly to a case where a liquid ejection head is of a page-wide type as described in this embodiment.

Figure 3:
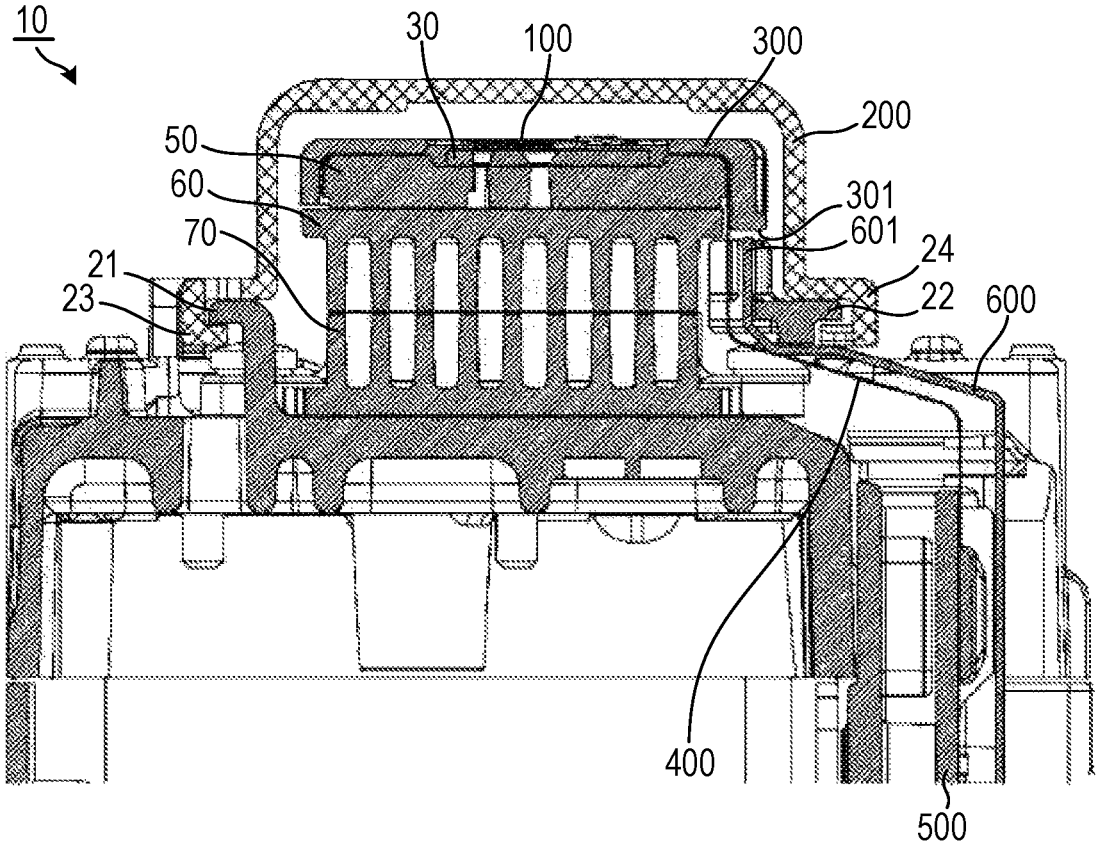
FIG. 3 is a cross-sectional view illustrating the liquid ejection head of the first embodiment.

FIG. 3 illustrates the configuration of the liquid ejection head unit 10 of the first embodiment in a state where the protective member 200 is mounted on the liquid ejection head 110. The liquid ejection head 110 has two rail portions 21, 22 which extend in the longitudinal direction of the liquid ejection head 110, and which are parallel to each other. The rail portion 21 has an L-shaped cross section which projects outward, that is, in the direction away from a center axis extending in the longitudinal direction of the liquid ejection head 110. The rail portion 22 forms a rail structure in cooperation with a cover member 600, and the rail structure has a U-shaped cross section which is open outward. On the other hand, the protective member 200 has a shape which covers whole surfaces of the recording element substrates 100 on the ejection orifice surface side. FIG. 3 is a cross-sectional view also illustrating the protective member 200, taken along a plane orthogonal to the longitudinal direction of the protective member 200. Sliding contact portions 23, 24 are formed on both sides of the protective member 200 in the lateral direction in the drawing, that is, in the short length direction of the protective member 200. Each of the sliding contact portions 23, 24 has a U-shaped cross section which is open inward, that is, is open in the direction facing toward the center axis of the liquid ejection head 110 extending in the longitudinal direction of the liquid ejection head 110. The sliding contact portions 23, 24 are respectively configured to be engaged with and fitted on the rail portions 21, 22 in a slidable manner. With such a configuration, the protective member 200 can be caused to slide with respect to the liquid ejection head 110 in the longitudinal direction of the liquid ejection head 110 (the Y direction in the drawing). Further, as described above, the protective member 200 can be mounted on or detached from the liquid ejection head 110.

The recording element substrate 100 having circulation paths has the ejection orifices which respectively correspond to recording liquids of four colors, for example. Further, the recording element substrate 100 is configured to allow a recording liquid which is not ejected from the ejection orifice to be recovered and circulate. To make recording liquids circulate through the recording element substrates 100, flow path members 50, 60, 70 are provided in the liquid ejection head 110. Flow paths for supplying recording liquid and flow paths for recovering recording liquid are formed on each of the flow path members 50, 60, 70, and the recording element substrates 100 are mounted on the flow path members 50 with a support member 30 interposed therebetween. The plurality of flow path members 50, 60, 70 have flow paths. Each of the flow path members 50, 60, 70 distribute the recording liquids into the plurality of recording element substrates 100, each of which has a large number of ejection orifices for respective colors. The flow path members 50, 60, 70 include the flow paths supplying the recording liquids to the respective ejection orifices. With such a configuration, a liquid in the pressure chamber, which includes the recording elements therein, can be made to circulate between an inside and an outside of the pressure chamber.

To drive recording elements (not illustrated in the drawing) formed on the recording element substrates 100, the recording element substrates 100 are electrically connected to one or more electric circuit boards 500 through a flexible printed circuit board 400. Further, the flexible printed circuit board 400 and at least a portion of the electric circuit boards 500 are covered by a cover member 600 made of metal. In this embodiment, the flexible printed circuit board 400 and the whole surface of the electric circuit boards 500 are covered by the cover member 600. The rail portion 22 is formed of a member which is to be attached to the cover member 600, and has a T shape in cross section. The cover member 600 made of metal is connected to each of electrical components disposed in the liquid ejection head unit 10 through ground wires. When the liquid ejection head unit 10 is installed into the liquid ejection apparatus 1000, the cover member 600 is electrically connected to a ground portion on the liquid ejection apparatus 1000 side. With such a configuration, it is possible to prevent electrostatic breakdown of the recording element substrate 100 or other components caused by static electricity generated due to handling of the liquid ejection head 110 by hand or due to vibrations caused during transportation. It is also possible to alleviate the effect of noise caused when a signal is transmitted to the liquid ejection head 110 at a high speed. In this embodiment, a portion of the rail portion 21 and a portion of the rail portion 22 are made of members made of metal, and are electrically connected to the cover member 600 made of metal. A portion of the cover member 600 made of metal is covered by the protective member 200. However, other portions of the cover member 600 are exposed from the protective member 200. With such a configuration, when the protective member 200 is mounted on or detached from the liquid ejection head 110 while causing the protective member 200 to slide on the rail portions 21, 22, static electricity generated due to such sliding can be released to the cover member 600 having a larger electrostatic capacity. Accordingly, it is possible to prevent electrostatic breakdown of the recording element substrate 100 or other components caused by static electricity generated in mounting or detaching the protective member 200. It is desirable to form at least a portion of the protective member 200, the rail portions 21, 22 and the sliding contact portions 23, 24 using a metal material. However, when a resin material is used, it is desirable to use a conductive resin. The protective member 200 is preferably made of metal or an antistatic material which is a conductive resin. In this embodiment, the rail portions 21, 22 are formed of separated members. However, the rail portions 21, 22 may be formed as an integral member made of metal.

In the liquid ejection head 110 of a page-wide type of this embodiment, the protective member 200 is mounted on or removed from the liquid ejection head 110 by causing the protective member 200 to slide along the longitudinal direction of the liquid ejection head 110. Further, the liquid ejection head 110 is mounted on or detached from the liquid ejection apparatus along the longitudinal direction of the liquid ejection head. With such a configuration, it is possible to ensure favorable operability in mounting or detaching the member. However, the member is moved in a sliding manner over a long distance and hence, a problem of static electricity is caused at the time. By adopting the configuration of the above-mentioned cover member made of metal, such a problem can be also easily solved.

In the liquid ejection head 110, there may be a case where, for example, air bubbles are generated in the flow path of the recording element substrate 100 so that the flow path is closed. Therefore, a suction member (not illustrated in the drawing) having a cap shape is mounted on the liquid ejection apparatus 1000, and suction recovery is performed. In the suction recovery, the suction member performs a suction operation from the ejection orifice surface side thus sucking air bubbles. A contact surface member 300 is disposed around the recording element substrates 100. The contact surface member 300 forms a surface with which the cap-shaped suction member used for the suction recovery comes into contact. Assume a case where the protective member 200 is made of a resin material. In such a case, there is a possibility that the protective member 200 is deformed due to an impact caused by dropping or the like of the liquid ejection head unit 10 thus interfering with the contact surface member 300 whereby the contact surface member 300 is deformed or broken. Such deformation or breakage is liable to be caused particularly at a portion of the contact surface member 300 where a surface of the portion which opposedly faces the interfering portion is not supported by another member when the protective member 200 interferes with the contact surface member 300. For example, such deformation or breakage is liable to be caused particularly at a portion such as a side surface portion 301. In an example illustrated in FIG. 3, the side surface portion 301 is a surface of the contact surface member 300 on the side opposite to a surface of the contact surface member 300 which faces in the same direction as the ejection orifice surface. In this embodiment, a support portion 601 which supports the side surface portion 301 of the contact surface member is formed of an end portion of the cover member 600 and a member formed on the rail portion 22. With such a configuration, it is possible to prevent breakage of the contact surface member 300 caused by interference of the protective member 200 at the time of dropping or the like.

Second Embodiment

Figure 4:
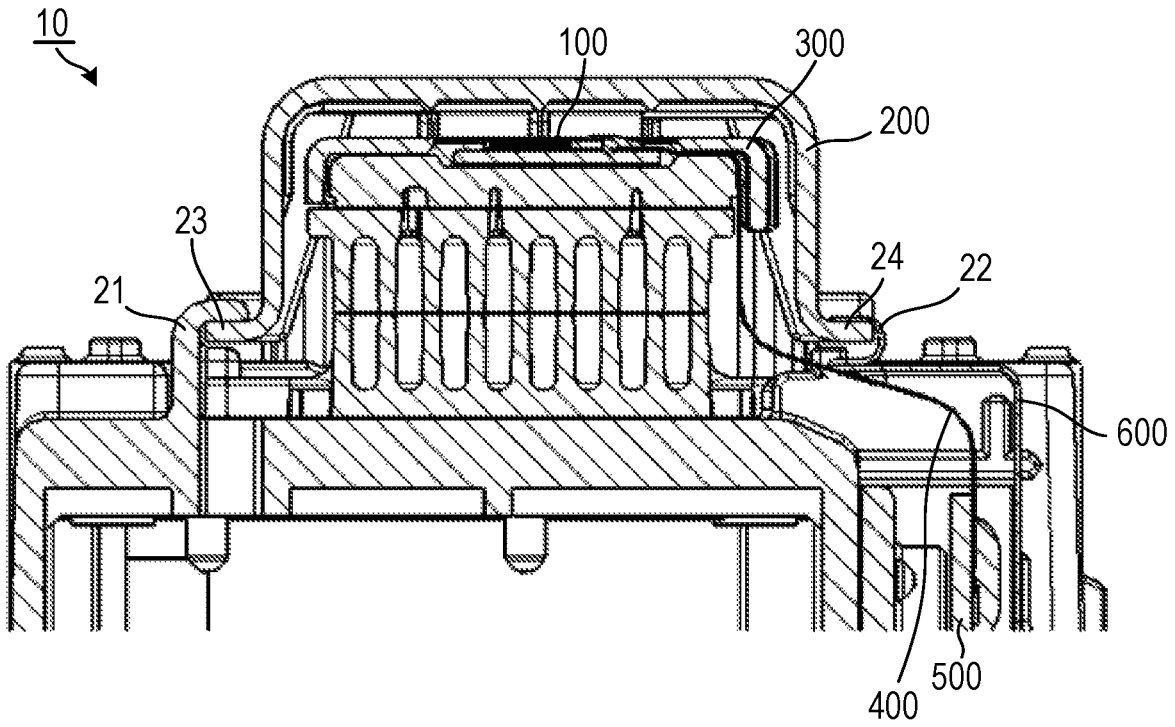
FIG. 4 is a cross-sectional view illustrating a liquid ejection head of a second embodiment.

FIG. 4 illustrates the configuration of a liquid ejection head unit 10 of a second embodiment in a state where a protective member 200 is mounted on the liquid ejection head unit 10. In this embodiment, the liquid ejection head unit 10 of the second embodiment is described only with respect to portions having a configuration different from the first embodiment. The description with respect to the portions which have substantially the same configurations as the first embodiment is omitted. In the second embodiment, an end portion of a cover member 600 made of metal is processed into a U shape which is open inward so as to form a rail portion 22. A rail portion 21 is also formed into a shape which is open inward thus having a U-shaped cross section. On the other hand, each of sliding contact portions 23, 24 of a protective member is formed into a shape which projects outward thus having an L-shaped cross section. The rail portion 21 and the rail portion 22 are formed of separated members in the drawing. However, the rail portion 21 and the rail portion 22 may be formed as an integral member made of metal. Further, the sliding contact portions 23, 24 of the protective member 200 are respectively fitted in the rail portions 21, 22 in the left-and-right direction. However, the sliding contact portions 23, 24 may have shapes which allow the sliding contact portions 23, 24 to be respectively fitted in the rail portions 21, 22 in the up-and-down direction.

Figure 5:
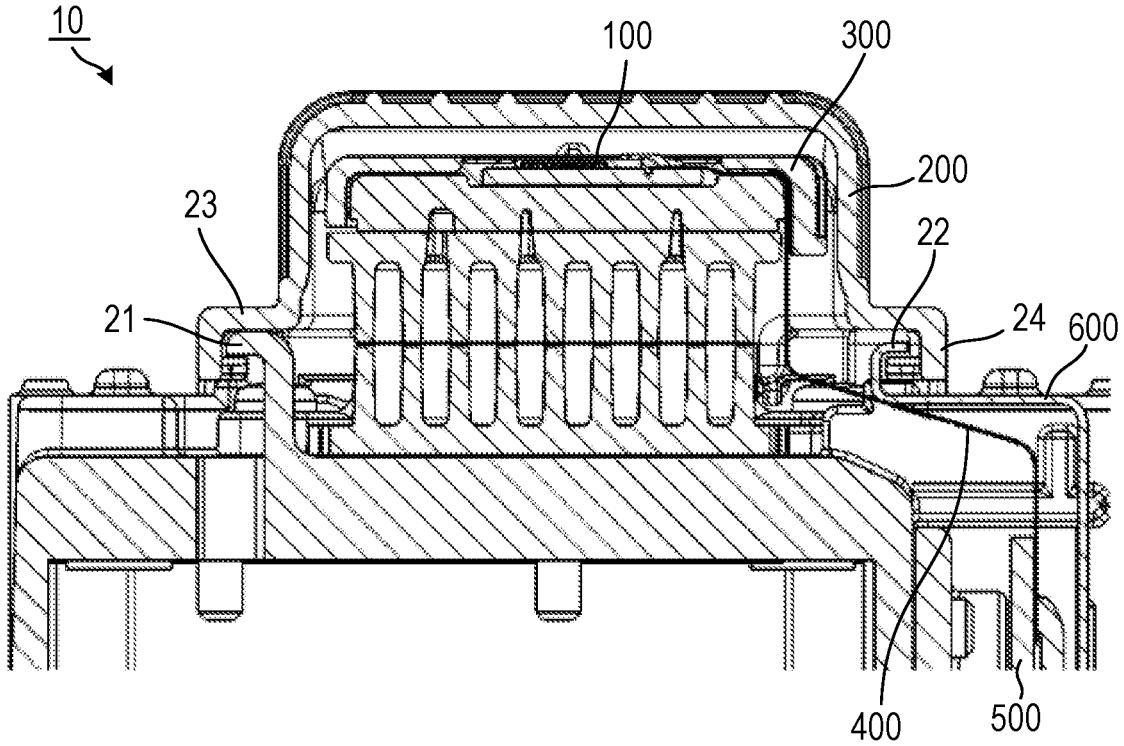
FIG. 5 is a cross-sectional view illustrating a liquid ejection head of a third embodiment.

FIG. 5 illustrates the configuration of a liquid ejection head unit 10 of a third embodiment in a state where a protective member 200 is mounted on the liquid ejection head unit 10. In this embodiment, the liquid ejection head unit 10 of the third embodiment is described only with respect to portions having a configuration different from the first embodiment. The description with respect to the portions which have substantially the same configurations as the first embodiment is omitted. In the liquid ejection head unit 10 illustrated in FIG. 5, an end portion of a cover member 600 made of metal is processed into a U shape which is open outward so as to form a rail portion 22. A rail portion 21 and sliding contact portions 23, 24 in this embodiment are formed in the same manner as the corresponding members in the first embodiment. The rail portion 21 and the rail portion 22 are formed of separated members in the drawing. However, the rail portion 21 and the rail portion 22 may be formed as an integral member made of metal. Further, the sliding contact portions 23, 24 of the protective member 200 are respectively fitted on the rail portions 21, 22 in the left-and-right direction. However, the sliding contact portions 23, 24 may have shapes which allow the sliding contact portions 23, 24 to be respectively fitted on the rail portions 21, 22 in the up-and-down direction.

According to the present invention, it is possible to provide a liquid ejection head which has high resistance against an impact caused by dropping or the like, and which is excellent in operability in removing a protective member.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-133993, filed Jul. 7, 2017, which is hereby incorporated by reference herein in its entirety.

What is claimed is:

1. A liquid ejection head unit comprising:

a liquid ejection head of a page-wide type to be installed in a liquid ejection apparatus, the liquid ejection head being formed by arranging a plurality of recording element substrates in a first direction, each of the recording element substrates having an ejection orifice from which a liquid is ejected;

a protective member configured to protect the plurality of recording element substrates; and a protrusion formed on the liquid ejection head, wherein the liquid ejection head includes a plurality of rail portions mutually extending along the first direction, and the protective member is movable along the rail portions between a first position and a second position, the first position allowing the protective member to cover whole surfaces of the plurality of recording element substrates, and the second position allowing the plurality of recording element substrates to be exposed so as to allow a liquid to be ejected from the ejection orifices, a fixing portion protruding from the protective member is formed on the protective member, when the protective member is at the first position, a contact surface of the fixing portion comes in contact with the protrusion, and the protective member becomes in a state so as to prevent movement of the protective member from the first position toward the second position, and when the fixing portion is pressed in a direction different from the first direction, the fixing portion is separated from the protrusion so that the protective member is allowed to move from the first position.

2. The liquid ejection head unit according to claim 1, wherein at least a portion of the rail portions is made of a metal material.

3. The liquid ejection head unit according to claim 2, wherein the protective member is made of an antistatic material.

4. The liquid ejection head unit according to claim 1, wherein a contact surface member is disposed around the plurality of recording element substrates, a suction member mounted on the liquid ejection apparatus comes into contact with the contact surface member, the contact surface member has a first surface and a second surface, the first surface facing in a same direction as a surface of the recording element substrate having the ejection orifice, and the second surface being disposed on a side opposite to the first surface, and at least a portion of the second surface is supported by the rail portion.

5. The liquid ejection head unit according to claim 1, further comprising a cover member made of metal which covers a portion of a side surface of the liquid ejection head, wherein the rail portion is made of a metal material, and the cover member and the rail portion are electrically connected with each other.

6. The liquid ejection head unit according to claim 5, wherein the liquid ejection head unit is installed in the liquid ejection apparatus in a state in which the protective member is installed on the liquid ejection head, and the cover member is electrically connected to a ground portion of the liquid ejection apparatus.

7. The liquid ejection head unit according to claim 1, further comprising at least one electric circuit board, a flexible printed circuit board configured to electrically connect the at least one electric circuit board and the plurality of recording element substrates with each other, and a cover member made of metal which covers the at least one electric circuit board and at least a portion of the flexible printed circuit board, wherein the rail portion is mounted on the cover member.

8. The liquid ejection head unit according to claim 7, wherein the rail portions are formed using the cover member.

9. The liquid ejection head unit according to claim 1, wherein the liquid ejection head unit is installed in the liquid ejection apparatus in a state in which the protective member is installed on the liquid ejection head.

10. The liquid ejection head unit according to claim 1, wherein the plurality of recording element substrates are arranged in a straight line along the first direction.

11. The liquid ejection head unit according to claim 1, wherein the plurality of recording element substrates are formed on a surface of the liquid ejection head, and a ratio of a short side to a long side of the surface is 1:7 or more.

12. The liquid ejection head unit according to claim 1, wherein each recording element substrate includes a recording element configured to generate energy for ejecting a liquid, and a pressure chamber having the recording element in the pressure chamber, and the liquid in the pressure chamber is made to circulate between an inside and an outside of the pressure chamber.

13. A liquid ejection apparatus comprising:

the liquid ejection head unit recited in claim 1; and an opening into which the liquid ejection head unit is to be inserted, wherein the liquid ejection head unit is inserted into the opening along the first direction.

14. The liquid ejection apparatus according to claim 13, wherein, when the liquid ejection head unit is inserted into the opening, the fixing portion comes into contact with and is pressed by a contact member formed in the opening so that the contact surface of the fixing portion is removed from the protrusion and the protective member is allowed to move from the first position.

15. The liquid ejection head unit according to claim 1, wherein the fixing portion is an elongated member having a support portion and a distal end portion, wherein the support portion is thin relative to a thickness of the distal end portion, and the contact surface is a side of the distal end portion.

16. The liquid ejection head unit according to claim 15, wherein, when the fixing portion is pressed in a direction different from the first direction, the support portion is bent, and the protective member is allowed to move from the first position by separating the contact surface from the protrusion due to bending of the support portion.

17. The liquid ejection head unit according to claim 1, wherein the contact surface is extended in a direction intersecting with the first direction.

18. A liquid ejection head unit comprising:

a liquid ejection head of a page-wide type configured to be detachably mounted in a liquid ejection apparatus, a plurality of recording element substrates being arranged in a first direction in the liquid ejection head, each of the recording element substrates having an ejection orifice from which a liquid is ejected;

a protective member configured to protect the plurality of recording element substrates; and a protrusion formed on the liquid ejection head, wherein the liquid ejection head includes a plurality of rail portions extending along the first direction, the rail portions being disposed on both sides of the plurality of recording element substrates in a direction orthogonal to the first direction, the protective member includes a sliding contact portion which comes into contact with the rail portions, and which moves in a sliding manner along the first direction, a fixing portion protruding from the protective member is formed on the protective member, when the protective member is at the first position, a contact surface of the fixing portion comes in contact with the protrusion, and the protective member becomes in a state so as to prevent movement of the protective member from the first position toward the second position, and when the fixing portion is pressed in a direction different from the first direction, the fixing portion is separated from the protrusion so that the protective member is allowed to move from the first position.

19. The liquid ejection head unit according to claim 18, wherein the liquid ejection head includes a flexible printed circuit board configured to be connected to the recording element substrates, and a cover member made of metal configured to cover at least a portion of the flexible printed circuit board, and the rail portions are made of a metal material, and the cover member and the rail members come into contact with each other.

20. The liquid ejection head unit according to claim 19, wherein the rail portions are formed using the cover member.

* * * * *